US009574756B2

(12) United States Patent
Akiyama et al.

(10) Patent No.: US 9,574,756 B2
(45) Date of Patent: Feb. 21, 2017

(54) LED LAMP

(71) Applicants: CITIZEN HOLDINGS CO., LTD., Nishitokyo-shi, Tokyo (JP); CITIZEN ELECTRONICS CO., LTD., Fujiyoshida-shi, Yamanashi (JP)

(72) Inventors: Takashi Akiyama, Sayama (JP); Masashi Watanabe, Fujiyoshida (JP); Takashi Shimura, Yamanashi (JP); Rintaro Takahashi, Tokorozawa (JP)

(73) Assignees: CITIZEN WATCH CO., LTD., Tokyo (JP); CITIZEN ELECTRONICS CO., LTD., Yamanashi (JP)

( * ) Notice: Subject to any disclaimer, the term of this patent is extended or adjusted under 35 U.S.C. 154(b) by 0 days.

(21) Appl. No.: 15/031,886

(22) PCT Filed: Aug. 15, 2014

(86) PCT No.: PCT/JP2014/071501
§ 371 (c)(1),
(2) Date: Apr. 25, 2016

(87) PCT Pub. No.: WO2015/064181
PCT Pub. Date: May 7, 2015

(65) Prior Publication Data

US 2016/0265727 A1 Sep. 15, 2016

(30) Foreign Application Priority Data

Oct. 28, 2013 (JP) ..... 2013-223419

(51) Int. Cl.
*F21V 23/00* (2015.01)
*F21V 29/83* (2015.01)
(Continued)

(52) U.S. Cl.
CPC ..... *F21V 23/006* (2013.01); *F21K 9/1355* (2013.01); *F21K 9/232* (2016.08);
(Continued)

(58) Field of Classification Search
CPC ..... F21V 23/006; F21V 17/101; F21V 29/77; F21V 29/89; F21V 29/83; F21V 29/506;
(Continued)

(56) References Cited

U.S. PATENT DOCUMENTS 8,926,132 B2 * 1/2015 Horng ..... F21V 29/02 362/249.02
2011/0298352 A1 * 12/2011 Velu ..... F21K 9/1355 313/46

(Continued)

FOREIGN PATENT DOCUMENTS

JP 2006310057 11/2006
JP 2009004130 1/2009

(Continued)

OTHER PUBLICATIONS

International Preliminary Report on Patentability issued in related International Application No. PCT/JP2014/071501, dated May 3, 2016. 2016.

(Continued)

*Primary Examiner* — Anne Hines
*Assistant Examiner* — Jose M Diaz
(74) *Attorney, Agent, or Firm* — RatnerPrestia

(57) ABSTRACT

An LED lamp has a substrate on which an LED is mounted, a dome-shaped translucent part covering the LED, a heat-radiating section connected to the substrate, a metal cap section to be connected to a power supply source, and a socket unit for connecting the heat-radiation section and the metal cap section, the socket unit having a socket opening section; the heat-radiating section having a body section
(Continued)

connected to the substrate, a plurality of heat-radiating fins connected to the body section, and a cover section connected to the heat-radiating fins, the cover section covering the heat-radiating fins; and an air channel being configured so as to pass through from a gap between the translucent part and the cover section, between the heat-radiating fins, and to the socket opening section.

4 Claims, 11 Drawing Sheets

(51) Int. Cl.

| | |
|---|---|
| ***F21V 29/89*** | (2015.01) |
| ***F21V 29/77*** | (2015.01) |
| ***F21K 99/00*** | (2016.01) |
| ***F21V 3/02*** | (2006.01) |
| ***F21V 17/10*** | (2006.01) |
| ***F21V 19/00*** | (2006.01) |
| *F21V 3/04* | (2006.01) |
| *F21V 29/506* | (2015.01) |
| *F21Y 101/00* | (2016.01) |
| *F21Y 101/02* | (2006.01) |

(52) U.S. Cl.
CPC ..... *F21V 3/02* (2013.01); *F21V 3/0436* (2013.01); *F21V 17/101* (2013.01); *F21V 19/001* (2013.01); *F21V 29/77* (2015.01); *F21V 29/83* (2015.01); *F21V 29/89* (2015.01); *F21V 3/0418* (2013.01); *F21V 29/506* (2015.01); *F21Y 2101/00* (2013.01); *F21Y 2101/02* (2013.01)

(58) Field of Classification Search
CPC ..... F21V 29/00; F21V 19/001; F21V 3/02; F21V 3/0436; F21V 3/0418; F21K 9/1355; F21K 9/232; H01L 33/64; H01L 23/34; F21Y 2101/02; F21Y 2101/00
See application file for complete search history.

(56) References Cited

U.S. PATENT DOCUMENTS

| | | | | |
|---|---|---|---|---|
| 2012/0194054 | A1* | 8/2012 | Johnston | H01J 7/24 313/46 |
| 2015/0098229 | A1* | 4/2015 | Tamura | F21K 9/1355 362/382 |
| 2015/0267909 | A1* | 9/2015 | Suzuki | F21V 29/74 362/294 |

FOREIGN PATENT DOCUMENTS

| | | |
|---|---|---|
| JP | 3168429 | 6/2011 |
| JP | 3173724 | 2/2012 |

OTHER PUBLICATIONS

International Search Report for International Application No. PCT/JP2014/071501 mailed Oct. 28, 2014.
Written Opinion of the International Searching Authority for International Application No. PCT/JP2014/071501 mailed Oct. 28, 2014.

* cited by examiner

LED LAMP

CROSS REFERENCE TO RELATED APPLICATIONS

This is the U.S. National Phase application of PCT International Application No. PCT/JP2014/071501, filed Aug. 15, 2014, and claims priority to Japanese Patent Application No. 2013-223419, filed Oct. 28, 2013, the disclosures of each of these applications being incorporated herein by reference in their entireties for all purposes.

FIELD OF THE INVENTION

The present invention relates to an LED lamp, and more particularly to an LED lamp comprising an LED (light-emitting diode) and a driving circuit for driving the LED.

BACKGROUND OF THE INVENTION

It is known in the art to provide an LED lighting device, similar in shape to a traditional incandescent bulb, that incorporates a heat sink having a plurality of heat sinking fins for removing the heat generated by LEDs (for example, refer to patent document 1). In this LED lighting device, the plurality of heat sinking fins is exposed to the outside in order to increase the heat sinking efficiency.

However, if the plurality of heat sinking fins is exposed to the outside, the appearance becomes significantly different from that of an incandescent bulb, and the user may feel that something is odd about the appearance. Furthermore, dirt, etc., tend to adhere to or be trapped between the heat sinking fins.

In view of the above, it is known to provide an LED illumination lamp in which a socket member and a cover member are provided so as to enclose the heat sinking fins with provisions made so that air introduced through the gap between the socket member and the cover member is made to pass near the heat sinking fins and is vented outside through a vent opening provided in the socket member (for example, refer to patent document 2).

However, if the sinking fins are enclosed by such members, not only does the heat sinking efficiency drop, but the number of components increases.

PATENT DOCUMENTS

Patent document 1: Japanese Unexamined Patent Publication No. 2009-4130

Patent document 2: Japanese Unexamined Patent Publication No. 2006-310057

SUMMARY OF THE INVENTION

It is an object of the present invention to provide an LED lamp that can resolve the above problems.

It is also an object of the present invention to provide an LED lamp that achieves good heat sinking efficiency and that is easy to fabricate.

There is provided an LED lamp includes a substrate on which an LED is mounted, a dome-shaped light transmissive envelope which covers the LED, a heat sink which is connected to the substrate, a base for connecting to a power supply, and a socket which connects the heat sink to the base and which includes a socket opening, wherein the heat sink includes a body connected to the substrate, a plurality of heat sinking fins connected to the body, and a cover that is connected to the plurality of heat sinking fins and that covers the plurality of heat sinking fins, and an air passage is formed leading from a gap formed between the light transmissive envelope and the cover to the socket opening by passing between the plurality of heat sinking fins.

Preferably, in the LED lamp, the heat sink includes a heat sink opening formed in the body, and the air passage is formed leading from the gap formed between the light transmissive envelope and the cover to the socket opening by passing between the plurality of heat sinking fins and by further passing through the heat sink opening.

Preferably, in the LED lamp, the plurality of heat sinking fins each include an abutting portion which abuts the light transmissive envelope on a side that faces the light transmissive envelope, and the gap for forming the air passage is formed between the abutting portion and the cover.

Preferably, in the LED lamp, with the light transmissive envelope contacting the substrate around a periphery thereof, the LED is shielded against air flowing through the air passage.

Preferably, the LED lamp further includes a driving circuit for driving the LED, wherein the socket includes a driving circuit accommodating portion for accommodating the driving circuit, and the body includes a socket accommodating portion for accommodating a portion of the socket.

Preferably, in the LED lamp, an outer circumferential surface of the socket accommodating portion of the body, the heat sink opening, and an inner surface of the body are arranged in a substantially straight line.

According to the LED lamp, since a significant quantity of air can be made to flow through the space formed inside the heat sink by the body, the plurality of heat sinking fins, and the cover, the heat sinking efficiency can be increased.

Further, since the heat sink is constructed by forming the body, the plurality of heat sinking fins, and the cover in integral fashion, the LED lamp of the present invention is easy to fabricate.

According to the LED lamp, since the air passage is formed along the heat sinking fins in such a manner that the air flowing therethrough does not contact the LED mounted on the substrate, dirt, etc., can be prevented from adhering to the LED.

DETAILED DESCRIPTION OF EMBODIMENTS OF THE INVENTION

LED lamps will be described below with reference to the drawings. However, it should be noted that the technical scope of the present invention is not limited by any particular embodiment described herein, but extends to the inventions described in the appended claims and their equivalents.

Figure 1:
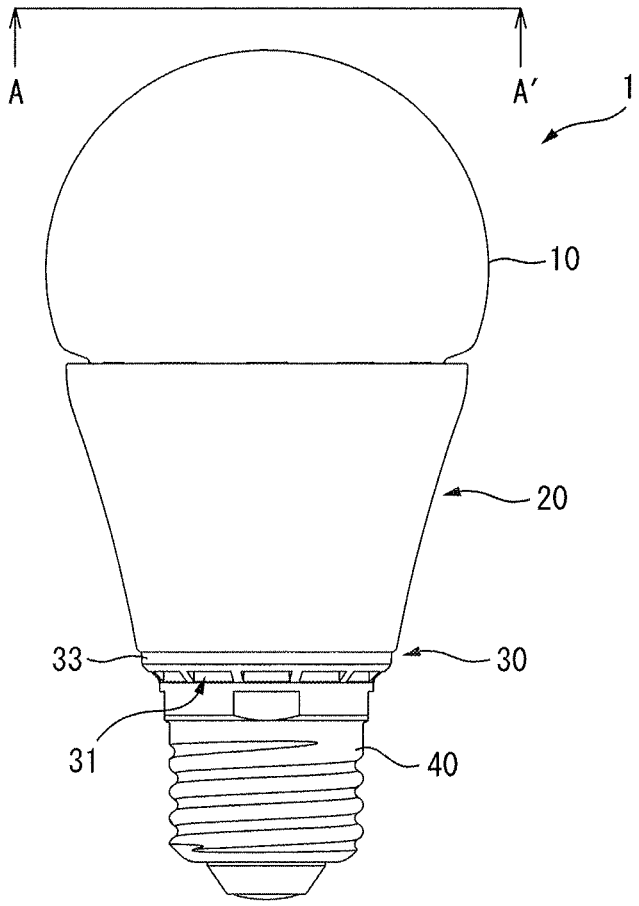
FIG. 1 is an external view of an LED lamp 1.
Figure 2:
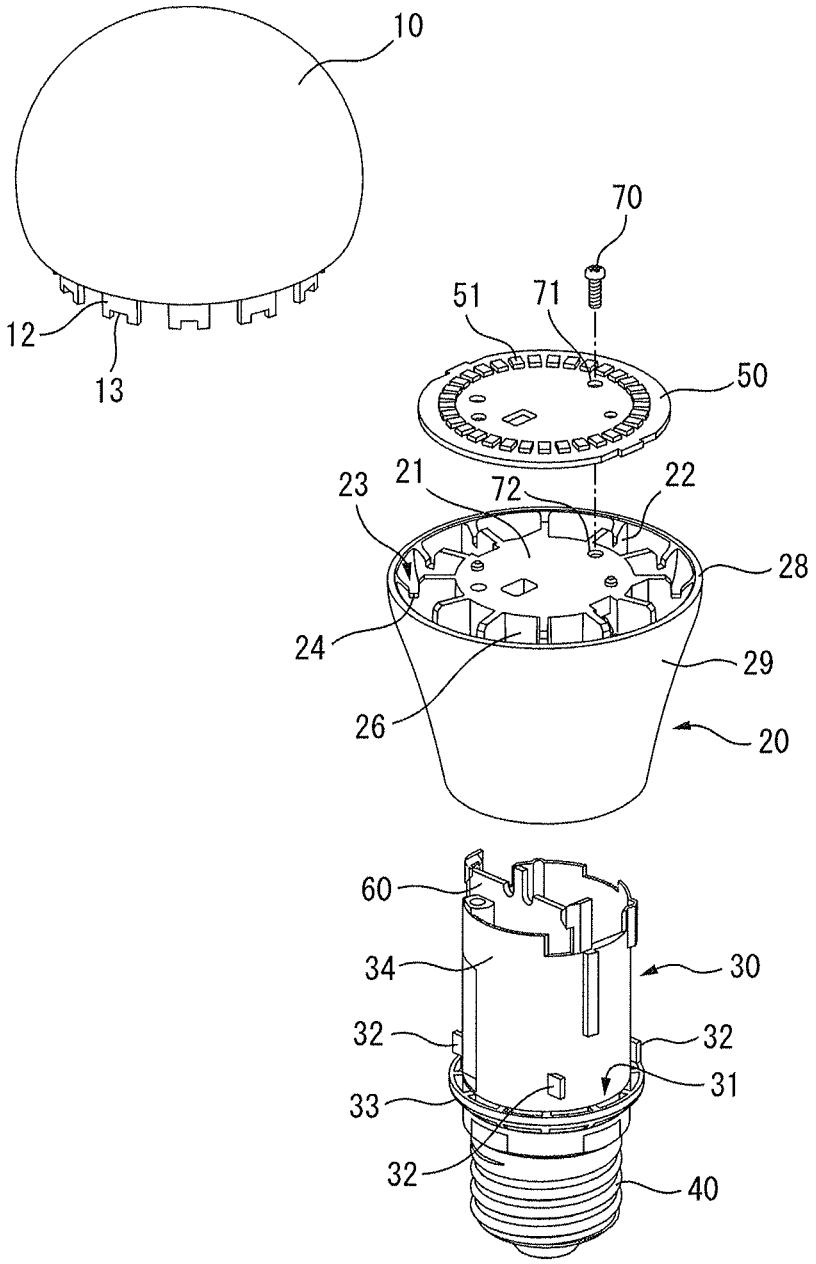
FIG. 2 is an exploded perspective view of the LED lamp 1.
Figure 3:
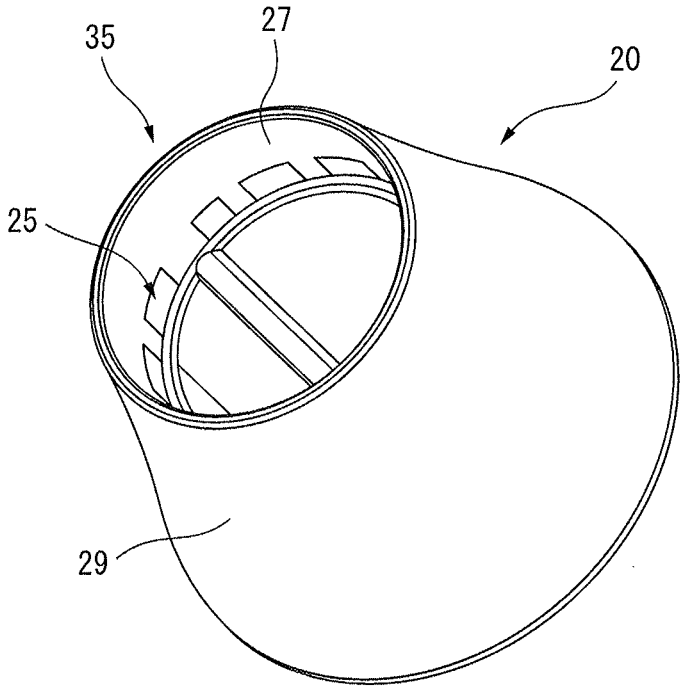
FIG. 3 is a perspective view of a heat sink 20.
Figure 4:
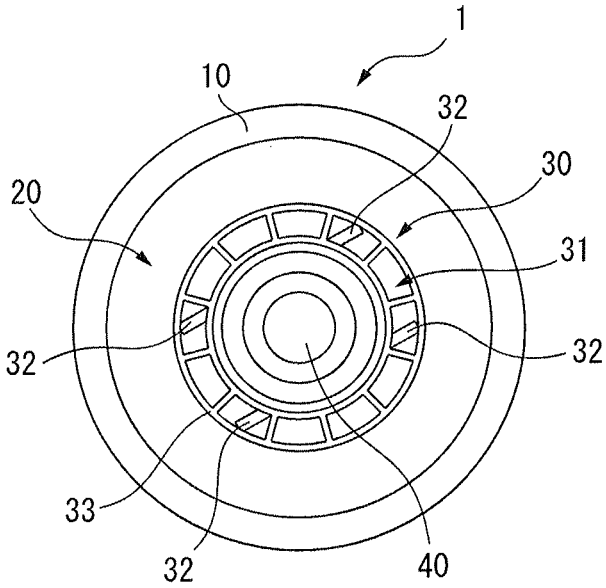
FIG. 4 is a bottom view of the LED lamp 1.

FIG. 1 is an external view of an LED lamp 1, FIG. 2 is an exploded perspective view of the LED lamp 1, FIG. 3 is a perspective view of a heat sink 20, and FIG. 4 is a bottom view of the LED lamp 1.

As shown in FIGS. 1 to 4, the LED lamp 1 comprises a light transmissive envelope 10, the heat sink 20, a socket 30, a base 40, a substrate 50 on which a plurality of LEDs 51 are mounted, a driving circuit 60 for driving the LEDs, and a screw 70 for fixing the substrate 50 to the heat sink.

The light transmissive envelope 10 is formed in the shape of a dome. A rim 11 formed around the lower edge of the light transmissive envelope 10 includes a plurality of protrusions 12 and a recess 13 formed in each protrusion 12. The light transmissive envelope 10 is formed from a non-transparent resin material that sufficiently scatters and transmits light emitted from the plurality of LEDs 51. The light transmissive envelope 10 may alternatively be formed from a transparent resin or glass material or from a non-transparent glass material.

As shown in FIG. 2, the heat sink 20 includes a cylindrically shaped body 21 to the upper surface of which the substrate 50 is fixed, a plurality of heat sinking fins 22, and a cover 29. The heat sink 20 has a socket accommodating opening 35, as shown in FIG. 3.

The body 21 has an outer circumferential surface 26 and an inner surface 27, and has a plurality of air passage openings 25 in the lower part thereof. Each heat sinking fin 22 is provided so as to connect between the body 21 and the cover 29.

The cover 29 includes a circular rim 28 around the upper edge thereof as viewed in FIG. 2, and is formed in the shape of a truncated cone so as to cover the entire body 21 and the plurality of heat sinking fins 22 and so as to prevent the body 21 and the plurality of heat sinking fins 22 from being exposed to the outside. The cover 29 is not necessarily configured to cover the entire body 21 and the plurality of heat sinking fins 22, but may be configured to cover only portions of them. However, from the standpoint of preventing dirt from adhering and the appearance from being impaired, it is preferable to form the cover so as to cover most of the heat sinking fins. Further, the outer shape of the cover 29 is not limited to a truncated cone shape, but may be formed in another suitable shape.

The heat sink 20 having the body 21, the plurality of heat sinking fins 22, and the cover 29 is formed in integral fashion from aluminum. The metal forming the heat sink 20 is not limited to aluminum, but another suitable metal may be used as long as the metal has a heat sinking effect.

The socket 30 is formed from a resin, and includes a plurality of protrusions 32, a rim 33 having a plurality of openings 31, and a driving circuit accommodating portion 34 of a cylindrical shape for accommodating therein the driving circuit 60 for driving the plurality of LEDs 51. The socket 30 in which the driving circuit 60 is accommodated is inserted through the socket accommodating opening 35 into the body 21 of the heat sink 20. The socket 30 also functions as an insulator interposed between the heat sink 20 and the base 40.

When the socket 30 is inserted into the body 21, the plurality of protrusions 32 engage the inner surface 27 of the body 21 so as to maintain a constant gap between the socket 30 and the inner surface 27 of the body 21 (see FIG. 4).

The base 40 is a cylindrically shaped member which is electrically connected to the driving circuit 60 accommodated in the cylindrically shaped accommodating portion 34 of the socket 30, and which is screwed into a lamp socket or the like so that power for lighting the plurality of LEDs 51 is supplied from an external power supply.

The substrate 50 on which the plurality of LEDs 51 are mounted is a circular plate member formed from a metal such as aluminum, and is configured so that the heat resulting from the operation of the plurality of LEDs 51 can be dissipated via the heat sink 20. The substrate 50 includes a through-hole 71 through which the screw 70 is threaded into a screw hole 72 formed in the heat sink 20. A heat conductive sheet or the like for enhancing the heat sinking effect may be placed between the substrate 50 and the heat sink 20.

Figure 5:
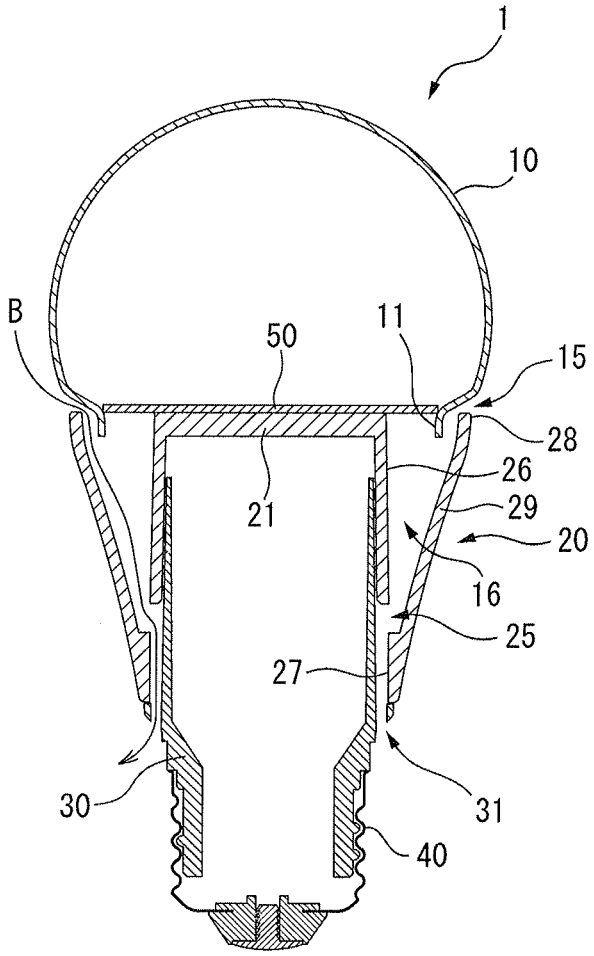
FIG. 5 is a cross-sectional view of the LED lamp 1 taken along line AA' in FIG. 1.
Figure 6:
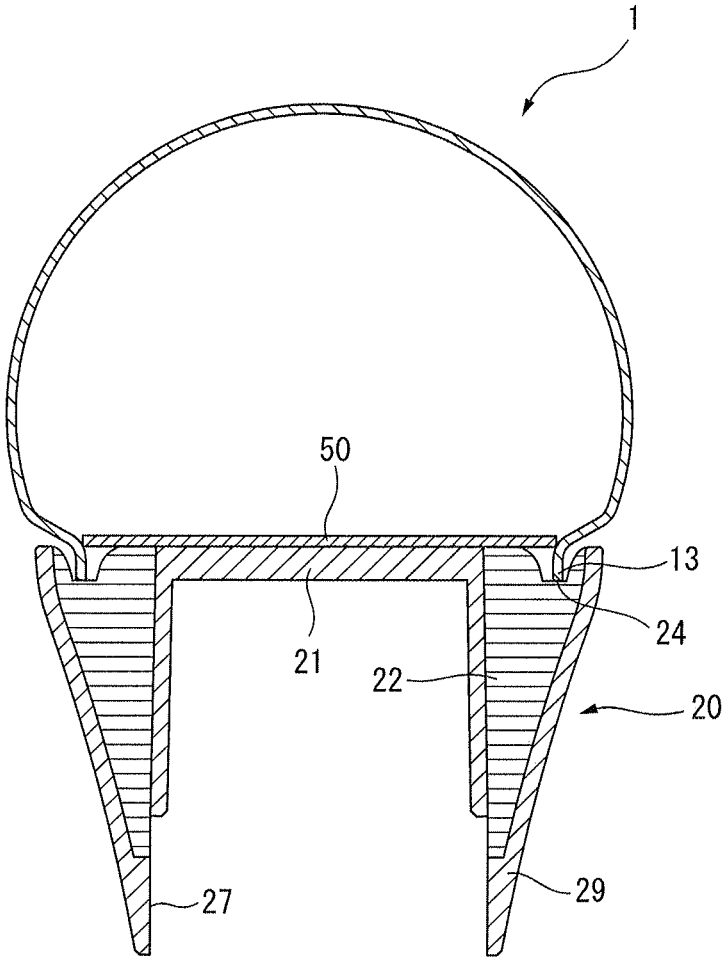
FIG. 6 is another cross-sectional view of the LED lamp 1.

FIG. 5 is a cross-sectional view of the LED lamp 1 taken along line AA' in FIG. 1 (taken along a portion where the heat sinking fins 22 are not located). FIG. 6 is a diagram showing a portion of a cross section of the LED lamp 1 taken along a portion where the heat sinking fins 22 are located.

As shown in FIG. 5, a gap 15 is formed between the rim 11 of the light transmissive envelope 10 and the rim 28 of the heat sink 20. An air passage is formed between the gap 15 and a space 16, which is formed inside the heat sink 20 by the outer circumferential surface 26 of the body 21, the cover 29, and the plurality of heat sinking fins 22. The air passage opening 25 is formed in the lower part of the space 16 as viewed in the figure. Further, an air passage is formed between the air passage opening 25 and the socket opening 31 of the socket 30 through the gap formed between the socket 30 and the inner surface 27 of the body 21. The gap between the socket 30 and the inner surface 27 of the body 21 is maintained constant by the plurality of protrusions 32, and is thus prevented from being crushed.

As described above, the LED lamp 1 includes an air passage B leading from the gap 15 to the socket opening 31 by passing through the space 16 and the air passage opening 25. A plurality of such air passages B are formed between the body 21 and the cover 29 of the heat sink 20; since the air passages B assist the dissipation of the heat conducted via the substrate 50 to the heat sink 20, the heat sinking efficiency of the heat sink 20 is extremely high. The direction of the air flowing through the air passage B depends on the mounting position, orientation, etc., of the LED lamp 1, and is therefore not limited to the direction of arrow shown in FIG. 5. Further, instead of the air passage B leading from the space 16 through the air passage opening 25 to the socket opening 31, a gap may be formed between the body 21 and the cover 29, and an air passage directly leading to the socket opening 31 may be formed, in which case the air passage opening 25 may be omitted.

As shown in FIG. 6, the light transmissive envelope 10 is fixed to the heat sink 20 by gluing, using an adhesive (not shown), the recess 13 formed in each protrusion 12 of the rim 11 of the light transmissive envelope 10 to the abutting face 24 of the recess 23 formed in the corresponding heat sinking fin 22.

With the outer periphery of the substrate 50 contacting the inside surface of the dome-shaped portion of the light transmissive envelope 10, the air passing through the air passage B is prevented from contacting the plurality of LEDs 51 mounted on the upper surface of the substrate 50. Since the air passing through the air passage B is thus blocked from entering the side on which the plurality of LEDs 51 are located, the structure prevents airborne dirt, etc. from infiltrating into the substrate side.

Figure 7A:
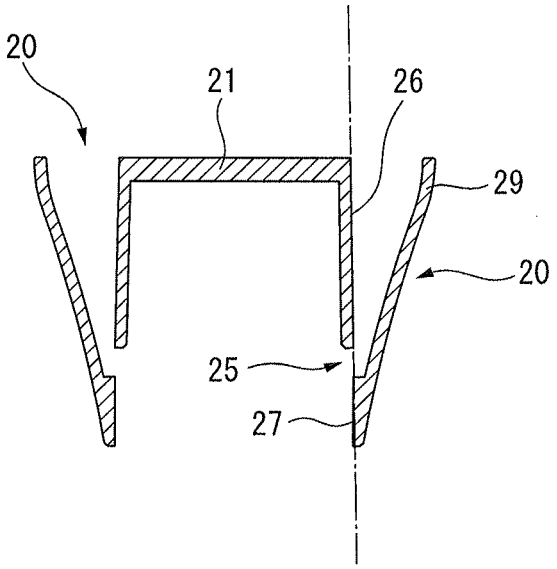
FIG. 7A is a cross-sectional view of the heat sink 20.
Figure 7B:
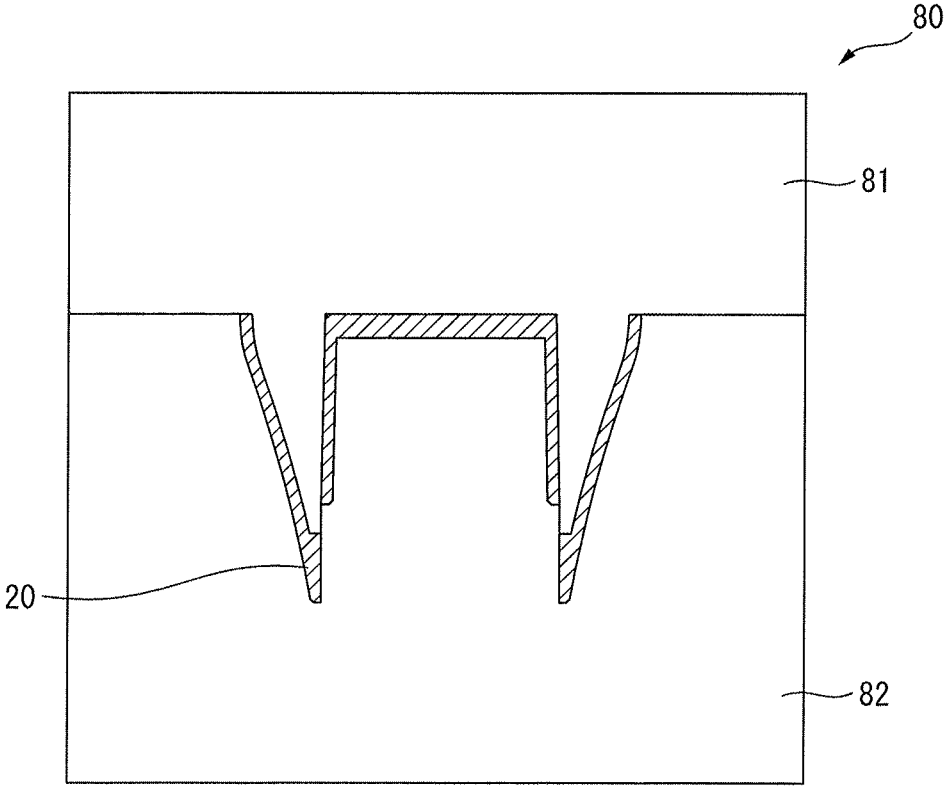
FIG. 7B is a diagram for explaining a mold used to form the heat sink 20.

FIG. 7A is a cross-sectional view of the heat sink 20, and FIG. 7B is a diagram for explaining a mold used to form the heat sink 20.

As shown in FIG. 7A, in the heat sink 20, the outer circumferential surface 26, the air passage opening 25, and the inner surface 27 of the body 21 are arranged in a substantially straight line. This is to facilitate integrally molding the heat sink 20 using a mold.

FIG. 7B shows one example of a mold 80 used to form the heat sink 20; as shown, the mold 80 includes a fixed mold part 81 and a movable mold part 82. The heat sink 20 is formed by closing the movable mold part 82 on the fixed mold part 81. After the aluminum has been solidified, the movable mold part 82 is removed, resulting in the formation of the air passage opening 25 together with the inner surface 27 of the body 21. This eliminates the need for an additional step for forming the air passage opening 25.

Figure 8:
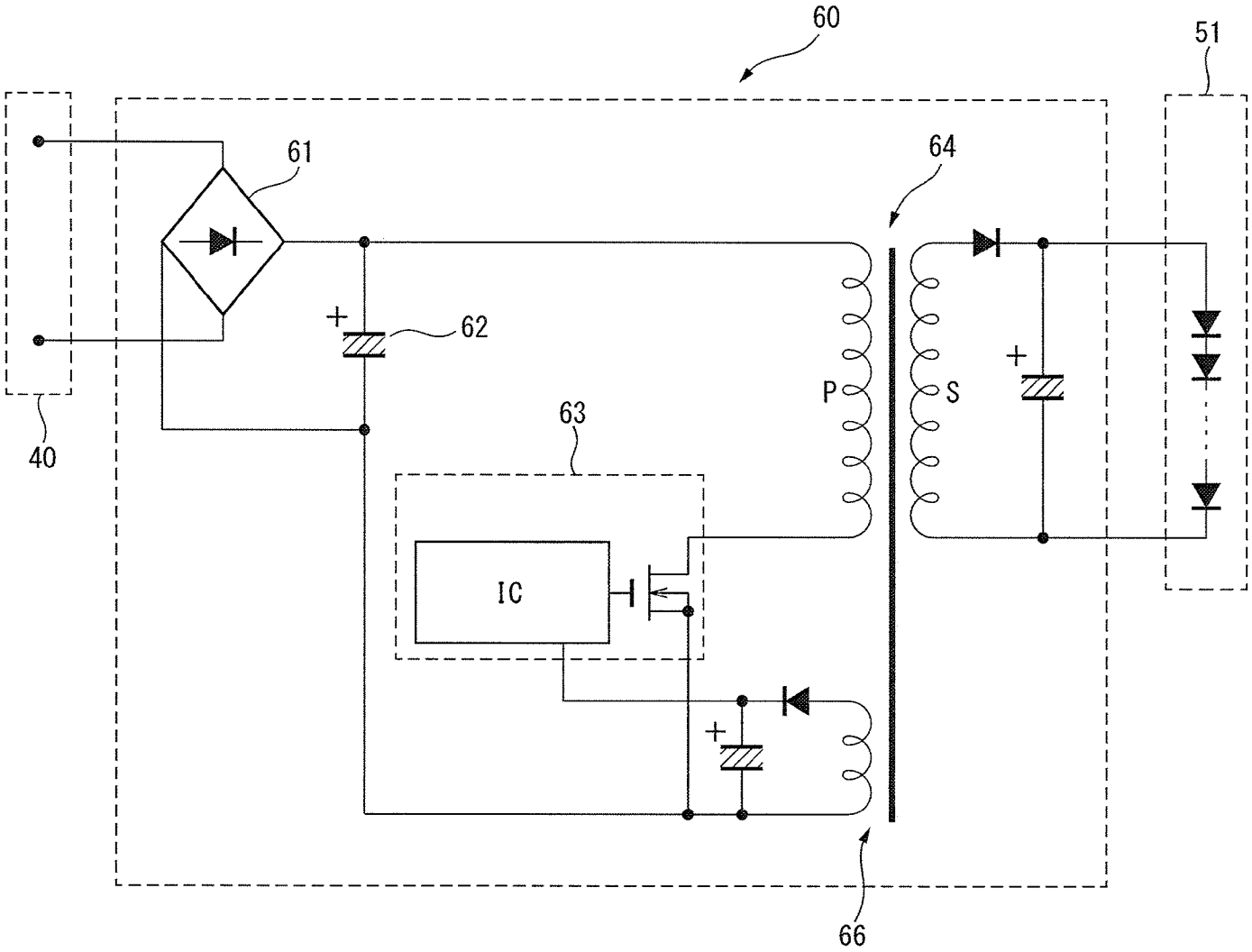
FIG. 8 is a diagram showing one example of a driving circuit 60.

FIG. 8 is a diagram showing one example of the driving circuit 60.

The driving circuit 60 shown in FIG. 8 is a switching power supply for a quasi-resonant AC-DC converter which converts the AC commercial power supplied via the base 40 into DC power and supplies the DC power to the plurality of LEDs 51.

The AC commercial power supplied via the base 40 is rectified and smoothed by a diode bridge circuit 61 and an electrolytic capacitor 62, and the rectified and smoothed power is supplied to the primary winding of a transformer 64 whose secondary winding is connected to the plurality of LEDs 51.

A control circuit 63 is provided which includes a power MOSFET and a switching power supply control IC and which, by monitoring the voltage across an auxiliary winding 66, controls the MOSFET to control the resonance, while performing control so that the voltage supplied to the plurality of LEDs 51 is maintained within a predetermined range.

The driving circuit 60 shown in FIG. 8 is only one example, and a driving circuit of another suitable type may be used to supply a predetermined voltage to the plurality of LEDs 51. Further, all of the plurality of LEDs 51 is not connected in series, but a plurality of LED arrays each comprising a predetermined number of LEDs connected in series may be connected in parallel to the secondary winding of the transformer 64.

Figure 9:
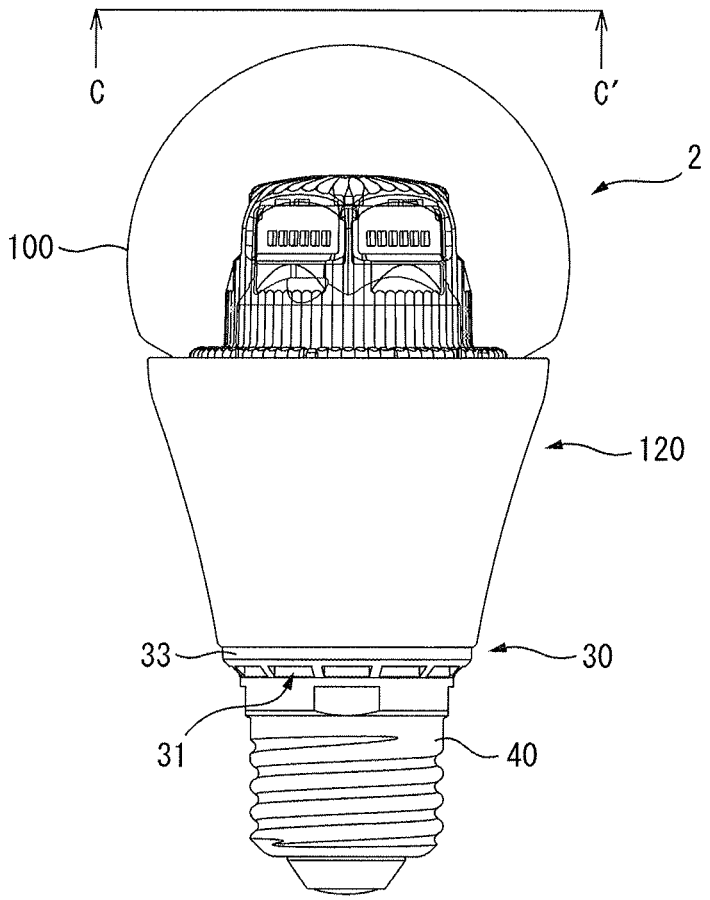
FIG. 9 is an external view of an alternative LED lamp 2.
Figure 10:
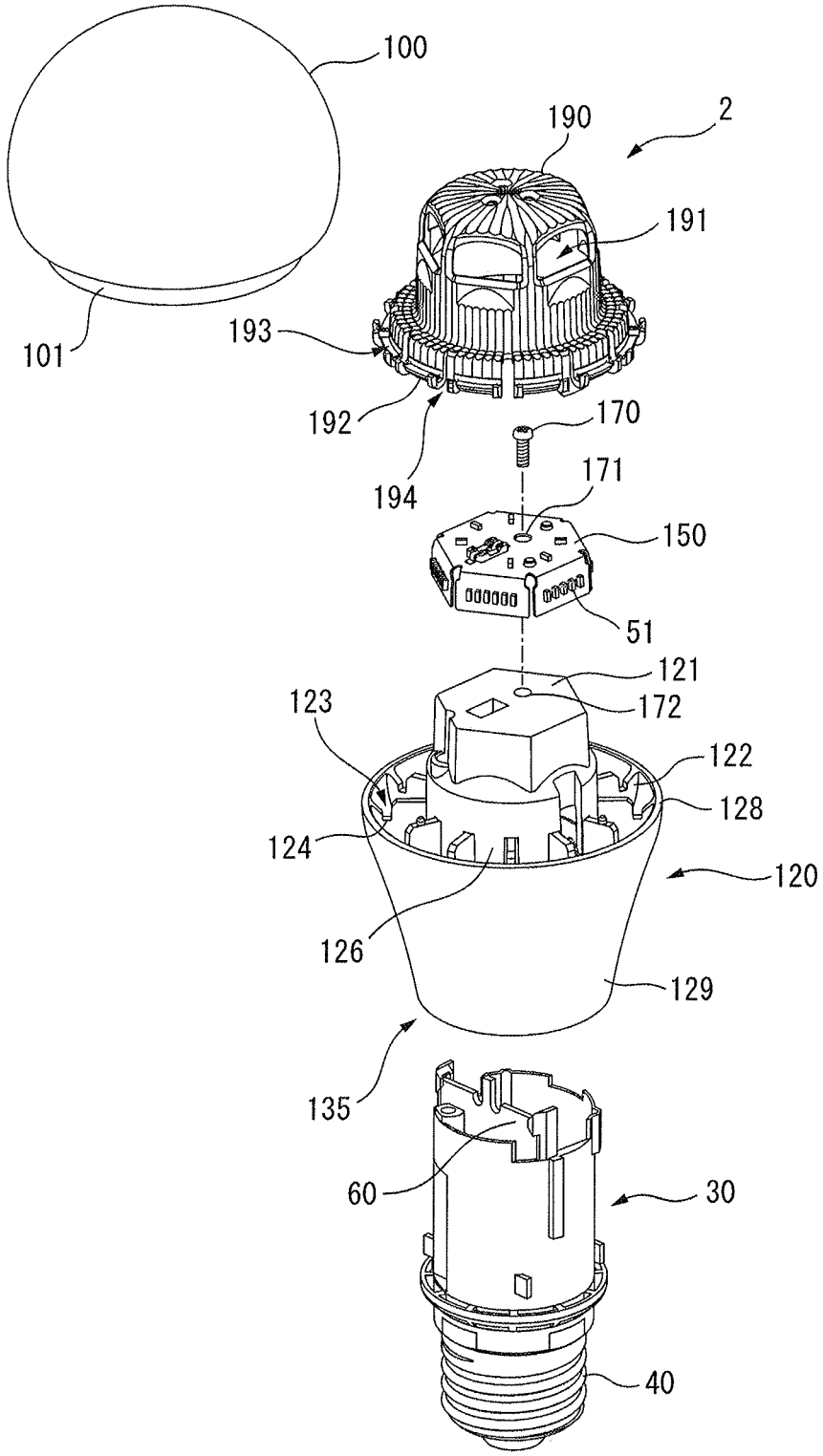
FIG. 10 is an exploded perspective view of the LED lamp 2.

FIG. 9 is an external view of an alternative LED lamp 2, and FIG. 10 is an exploded perspective view of the LED lamp 2. In the LED lamp 2, the same component elements as those of the LED lamp 1 shown in FIGS. 1 to 8 are designated by the same reference numerals, and the description of such component elements will not be repeated herein.

The LED lamp 2 comprises a light transmissive envelope 100, a heat sink 120, a socket 30, a base 40, a substrate 150 on which a plurality of LEDs 51 are mounted, an LED cover 190 which covers the plurality of LEDs 51, a driving circuit 60 for driving the LEDs, and a screw 170 for fixing the substrate 150 to the heat sink.

The light transmissive envelope 100 is formed in the shape of a dome, and includes a rim 101 which is formed around the lower edge thereof as viewed in FIG. 10. The light transmissive envelope 100 is formed from a transparent resin material, but may alternatively be formed from a transparent glass material.

The heat sink 120 includes a body 21 to the upper surface (as viewed in FIG. 10) of which the substrate 150 is fixed, a plurality of heat sinking fins 122, and a cover 129. The heat sink 120 has a socket accommodating opening 135.

The body 121 has an outer circumferential surface 126 and an inner surface 127, and has a plurality of air passage openings 125 in the lower part thereof as viewed in FIG. 9. Each heat sinking fin 122 is provided so as to connect the body 121 with the cover 129 respectively, and includes a recess 123 in the upper part thereof as viewed in FIG. 10 and a face 124 at the bottom of the recess 123. The body 121 has, in its upper part as viewed in FIG. 10, a protrusion formed in the shape of a truncated hexagonal pyramid to conform to the shape of the substrate 150, but the part lower than the protrusion of the truncated hexagonal pyramid, as viewed in FIG. 10, is formed in a cylindrical shape in the same manner as the body 21 of the LED lamp 1.

The cover 129 includes a circular rim 128 around the upper edge thereof as viewed in FIG. 10, and is formed in the shape of a truncated cone so as to cover the entire body 121 and the plurality of heat sinking fins 122 and so as to prevent the body 121 and the plurality of heat sinking fins 122 from being exposed to the outside. The cover 129 need not necessarily be configured to cover the entire body 121 and the plurality of heat sinking fins 122, but may be configured to cover only portions of them. However, from the standpoint of preventing dirt from adhering and the appearance from being impaired, it is preferable to form the cover so as to cover most of the heat sinking fins 122.

The heat sink 120 having the body 121, the plurality of heat sinking fins 122, and the cover 129 is formed in integral fashion from aluminum. However, the metal forming the heat sink 120 is not limited to aluminum, but another suitable metal may be used as long as the metal has a heat sinking effect.

The socket 30, the base 40, and the driving circuit 60 are the same as those used in the earlier described LED lamp 1, and therefore, will not be further described herein.

The substrate 150 on which the plurality of LEDs 51 are mounted is formed from a metal such as aluminum, and has a hexagonal plane surface and six side faces connected to the respective sides of the plane surface. The substrate 150 is configured so that the heat resulting from the operation of the plurality of LEDs 51 can be dissipated via the heat sink 120. The substrate 150 includes a through-hole 171 through which the screw 170 is threaded into a screw hole 172 formed in the heat sink 120. A heat conductive sheet or the like for enhancing the heat sinking effect may be placed between the substrate 150 and the heat sink 120.

The LED cover 190 is formed from a transparent resin, and is placed so as to cover the substrate 151 from above. A plurality of openings 191 are formed in the side walls of the LED cover 190 so that the light emitted from the plurality of LEDs 51 mounted on the side faces of the substrate 151 can be directly emitted to the outside.

The lower part of the LED cover 190, as viewed in FIG. 10, is provided with a plurality of protrusions 192 each of which includes an arc-shaped supporting portion 193. A cutout portion 194 is formed between any two adjacent protrusions 192. The LED cover 190 is mounted on the substrate 151 with each cutout portion 194 engaging on one of the plurality of heat sinking fins 122 of the heat sink 120 and with the outer end of each protrusion 192 inserted between one heat sinking fin 122 and its adjacent heat sinking fin 122.

Figure 11:
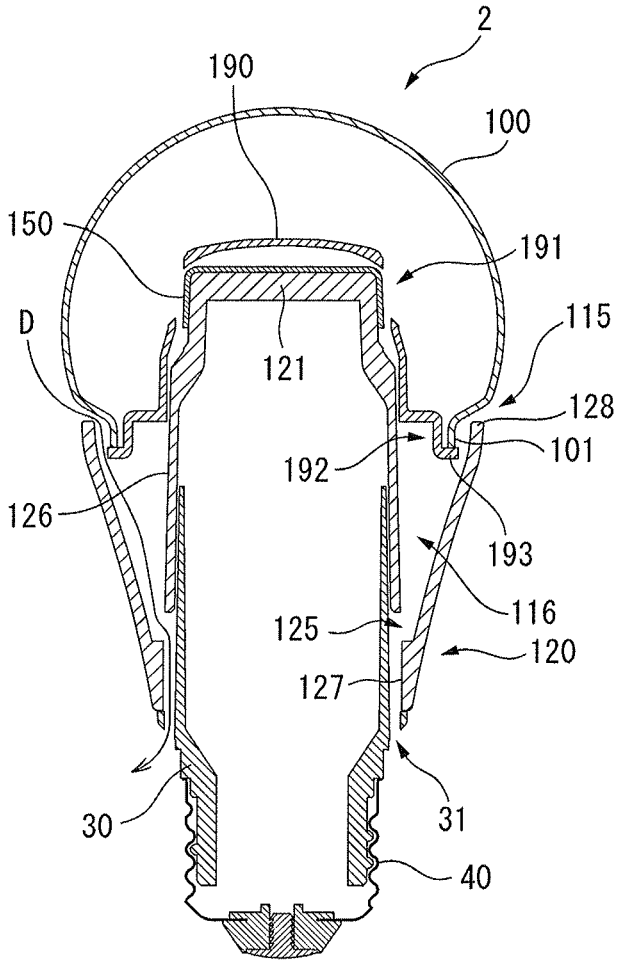
FIG. 11 is a cross-sectional view of the LED lamp 2 taken along line CC' in FIG. 9.
Figure 12:
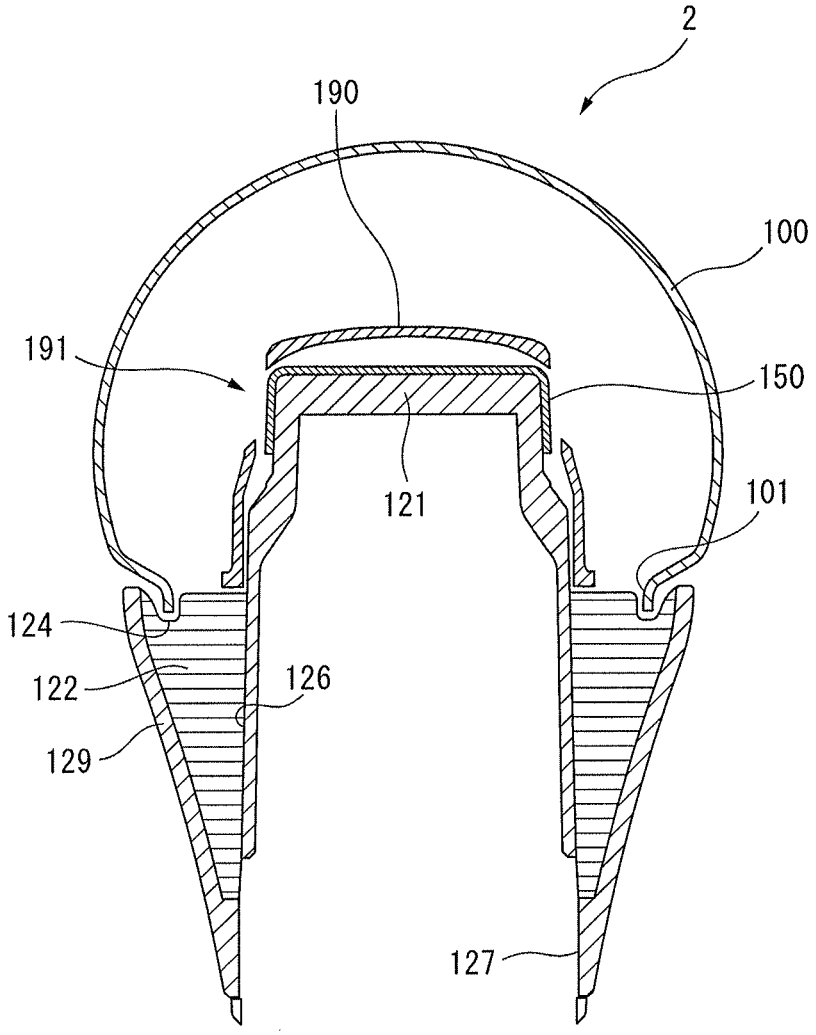
FIG. 12 is another cross-sectional view of the LED lamp 2.

FIG. 11 is a cross-sectional view of the LED lamp 2 taken along line CC' in FIG. 9 (taken along a portion where the heat sinking fins 122 are not located). FIG. 12 is a diagram showing a portion of a cross section of the LED lamp 2 taken along a portion where the heat sinking fins 122 are located.

As shown in FIG. 11, a gap 115 is formed between the rim 101 of the light transmissive envelope 100 and the rim 128 of the heat sink 120. An air passage is formed between the gap 115 and a space 116, which is formed inside the heat sink 120 by the outer circumferential surface 126 of the body 121, the cover 129, and the plurality of heat sinking fins 122. The air passage opening 125 is formed in the lower part of the space 116 as viewed in FIG. 11. Further, an air passage is formed between the air passage opening 125 and the socket opening 31 of the socket 30 through the gap formed between the socket 30 and the inner surface 127 of the body 121. The gap between the socket 30 and the inner surface 127 of the body 121 is maintained constant by the plurality of protrusions 32 and is thus prevented from being crushed.

As described above, the LED lamp 2 includes an air passage D leading from the gap 115 to the socket opening 31 by passing through the space 116 and the air passage opening 125. A plurality of such air passages D are formed between the body 121 and the cover 129 of the heat sink 120; since the air passages D assist the dissipation of the heat conducted via the substrate 150 to the heat sink 120, the heat sinking efficiency of the heat sink 120 is extremely high. The direction of the air flowing through the air passage D depends on the mounting position, orientation, etc., of the LED lamp 2, and is therefore not limited to the direction of arrow shown in FIG. 11. Further, instead of the air passage D leading from the space 116 through the air passage opening 125 to the socket opening 31, a gap may be formed between the body 121 and the cover 129, and an air passage directly leading to the socket opening 31 may be formed, in which case the air passage opening 125 may be omitted.

As shown in FIG. 11, the light transmissive envelope 100 and the LED cover 190 are fixed together by gluing the rim 101 of the light transmissive envelope 100 to the supporting portions 193 of the LED cover 190 by using an adhesive (not shown). Since the LED cover 190 is fixed to the heat sink 120, the light transmissive envelope 100 is fixed with respect to the heat sink 120.

As shown in FIG. 12, unlike the LED lamp 1, the rim 101 of the light transmissive envelope 100 is not glued to the face 124 of the recess 123 formed in each heat sinking fin 122.

With the rim 101 of the light transmissive envelope 100 glued to the supporting portions 193 of the LED cover 190, the air passing through the air passage D is prevented from contacting the plurality of LEDs 51 mounted on the upper surface of the substrate 150. Since the air passing through the air passage D is thus blocked from entering the side on which the plurality of LEDs 51 are located, the structure prevents airborne dirt, etc., from infiltrating into the substrate side.

DESCRIPTION OF THE REFERENCE NUMERALS

1, 2 . . . LED LAMP
10, 100 . . . LIGHT TRANSMISSIVE ENVELOPE
15, 115 . . . GAP
20, 120 . . . HEAT SINK
21, 121 . . . BODY
22, 122 . . . HEAT SINKING FIN
25, 125 . . . AIR PASSAGE OPENING
29, 129 . . . COVER
30 . . . SOCKET
31 . . . SOCKET OPENING
40 . . . BASE
50, 150 . . . SUBSTRATE
60 . . . DRIVING CIRCUIT
70 . . . SCREW
B, D . . . AIR PASSAGE

What is claimed is:

1. An LED lamp comprising:

a substrate on which an LED is mounted;

a dome-shaped light transmissive envelope which covers the LED;

a heat sink which includes a body connected to the substrate, a heat sink opening formed in the body, a plurality of heat sinking fins connected to the body, and a cover that is connected to the plurality of heat sinking fins and that covers the plurality of heat sinking fins;

a base for connecting to a power supply;

a driving circuit for driving the LED; and a socket which connects the heat sink to the base and which includes a socket opening and a driving circuit accommodating portion for accommodating the driving circuit, wherein an air passage is formed leading from a gap formed between the light transmissive envelope and the cover to the socket opening by passing between the plurality of heat sinking fins, the plurality of heat sinking fins and the cover are formed in integral fashion, the plurality of heat sinking fins are covered by the cover so as not to be exposed outside the cover, the body includes a socket accommodating portion for accommodating a portion of the socket, and the heat sink opening is located above an inner surface of the body as seen from the socket, and an outer circumferential surface of the socket accommodating portion is located above the heat sink opening.

2. The LED lamp according to claim 1, wherein the air passage is formed leading from the gap formed between the light transmissive envelope and the cover to the socket opening by passing between the plurality of heat sinking fins and by further passing through the heat sink opening.

3. The LED lamp according to claim 1, wherein the plurality of heat sinking fins each include an abutting portion which abuts the light transmissive envelope on a side that faces the light transmissive envelope, and the gap for forming the air passage is formed between the abutting portion and the cover.

4. The LED lamp according to claim 1, wherein with the light transmissive envelope contacting the substrate around a periphery thereof, the LED is shielded against air flowing through the air passage.

* * * * *